United States Patent [19]

Feigl

[11] Patent Number: 4,570,684

[45] Date of Patent: Feb. 18, 1986

[54] TAPE RESTRAINING SHOE FOR SHUTTLELESS LOOMS

[75] Inventor: Rudolf F. Feigl, Burlington, N.C.

[73] Assignee: Draper Corporation, Greensboro, N.C.

[21] Appl. No.: 605,235

[22] Filed: Apr. 30, 1984

[51] Int. Cl.[4] ..... D03D 47/00

[52] U.S. Cl. ..... 139/449

[58] Field of Search ..... 139/446, 449, 444, 445, 139/183

[56] References Cited

U.S. PATENT DOCUMENTS

| | | | |
|---|---|---|---|
| 3,198,215 | 8/1965 | Tinkham | 139/449 |
| 3,323,555 | 6/1967 | Hamand | 139/449 |
| 3,464,456 | 9/1969 | Brandon | 139/183 |
| 3,490,498 | 1/1970 | Dewas | 139/449 |

*Primary Examiner*—Henry S. Jaudon

*Attorney, Agent, or Firm*—Charles R. Rhodes; Judith E. Garmon

[57] ABSTRACT

The tape restraining shoe for a shuttleless loom includes an arcuately shaped body member having a replaceable polymeric wear strip in the sole portion thereof. The tape restraining shoe is adjustably mounted to maintain the wear strip at a prescribed distance from the underlying rapier or flexible inserting tape. The shoe is mounted on the stationary plate of the oscillating wheel by means of bolts extending through a pair of elongated slots in the upper portion of the body of the tape restraining shoe, which slots extend perpendicular to the sole portion.

9 Claims, 3 Drawing Figures

TAPE RESTRAINING SHOE FOR SHUTTLELESS LOOMS

BACKGROUND AND SUMMARY OF PRESENT INVENTION

It is well-known that in shuttleless looms the filling thread is drawn from an outside source and inserted in the warp shed by flexible inserting members such as tapes or rapiers which are repeatedly wrapped about and extended from oscillating wheels by which they are driven. When the flexible tapes are being withdrawn from the warp shed they are wrapped tightly against the rim or outer periphery of their respective oscillating tape wheel; but when being unwrapped from the wheel and inserted into the shed, a guide means such as a tape restraining shoe is required to hold the tape radially inward and in close proximity to the rim of the wheel. The more common form of tape restraining shoe is an arcuate member made of a material such as wood, plastic, or metal. Each of the oscillating wheels has mounted on the frame thereof a plurality of tape restraining shoes which are circumferentially disposed about the outer periphery of the wheel. The inner arcuate surface of each shoe generally includes a wear and friction resistant sole for reducing friction as the flexible tape member is wound and unwound from the wheel at very high speeds.

The frictional heat created by the repeated oscillations of the wheel members and the movement of the tape against the outer surface of the tape shoe creates a condition called "bowing" of the flexible tapes. This lateral or transverse bowing condition is a serious detriment to the operation of the loom because it alters the intended position of the carrier members at the filling transfer point within the shed. When the condition is extreme and both tapes are caused to bow, perhaps in opposite directions, a more serious problem results whereby one carrier may fail to transfer the filling thread in synchronization with the receiving carrier; thus creating the possibility of a collision between the carriers that results in breakage thereof and the tearing or knotting of many of the warp threads. This problem has been recognized and a solution proposed in U.S. Pat. No. 3,323,555. The solution involves the provision of air ventilating ports in the housing adjacent the restraining shoes. While this approach has improved the bowing problem somewhat, other problems remain.

The frictional heat and excessive wear on the inner surface of the tape restraining shoe causes the wear resistant sole to soften and wear away to the extent that it increases the frictional drag on the tape members. In the past there has been no reasonable and efficient means for easily replacing these wear strips and most loom operators remove the entire tape restraining shoe, discard it, and replace it with a new shoe. The discarded shoe is either refurbished or discarded. This is obviously an expensive solution to the problem.

A still further problem with the tape restraining shoes has been the lack of a means for maintaining the wear strip of the shoe at a prescribed distance from the surface of the retractable tape. With known shoes there is only one position for mounting the shoe to the wheel frame and there has been no means for adjusting the position of the shoe to increase or decrease the distance between the surface of the wear strip and the flexible tape. Being able to make such an adjustment would significantly increase the life of the wear resistant material or surface on the shoe member.

It is to overcoming all of the above disadvantages by providing an improved tape restraining shoe that the present invention is directed. The invention is an improved tape restraining shoe having a means for mounting and positioning the shoe on the oscillating wheel frame such that the distance between the wear resistant surface of the shoe and the flexible inserting members can be adjusted; either at the time of initially mounting the shoe, or after the wear resistant sole has begun to wear away.

The adjustment means comprises a pair of elongated slots or apertures, spaced apart from each other, in the yoke portion of the shoe. The elongation of the apertures allows for incremental positioning of these apertures over those on the wheel supporting plate to which the shoes are attached. Once positioned, a fastener is inserted through the elongated aperture at any point and into the aperture on the wheel frame. The head of the nut or screwfastener, when tightened, will bias the shoe against the wheel supporting plate to hold the shoe securely in position. Additionally the arcuate undersurface of the improved shoe includes a groove or track means for receiving and releasably holding a replaceable wear strip therein such that an old strip can be simply removed and replaced with a new one without the necessity of discarding or refurbishing the entire shoe.

Further, the body portion of the improved tape restraining shoe is made from a heat conductive zinc aluminum alloy that will rapidly conduct heat away from the flexible inserting members and the replaceable wear resistant strip. The strip itself preferably is formed of Rulon TM, a highly strong, heat absorbent material. By using such a material for forming the body of the tape restraining shoe to induce heat away from the flexible inserting members, the life of the inserting members is prolonged and there is a significant decrease in the likelihood of tape bowing.

Other and further modifications of the invention may become apparent to those skilled in the art as the following detailed description is studied in conjunction with the accompanying drawings in which.

DETAILED DESCRIPTION OF A PREFERRED EMBODIMENT

Figure 1:
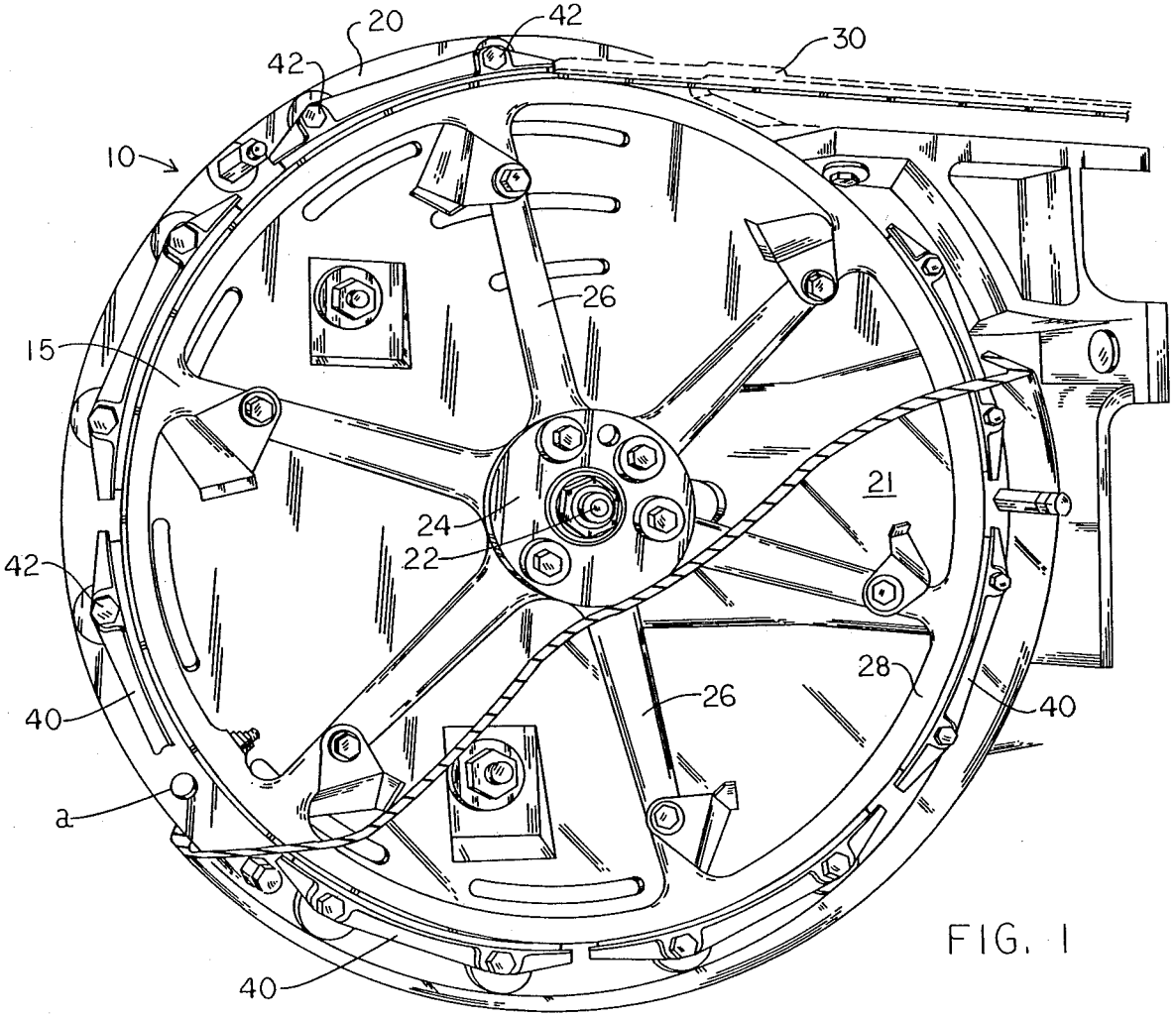
FIG. 1 is a perspective view of the oscillating inserting wheel portion of a shuttleless loom, looking from the front thereof.

Looking first at FIG. 1, the tape wheel housing 10 of a shuttleless loom is shown as it would be seen if looking from the front. It is, of course, understood that a duplicate tape wheel is found on the opposite side of the loom. A tape wheel 15 is mounted for oscillating movement on an underlying supporting plate or member 20, oscillating about a centrally disposed lug member 22. The tape wheel includes a hub portion 24, a plurality of radially extending spoke members 26, and a surrounding rim 28. Rim 28 functions as a guide for the flexible tape members 30 which are repeatedly wrapped about and extended from the wheel as it is caused to oscillate. The tapes are further guided and restrained by the plurality of arcuate tape restraining shoes 40 which are disposed circumferentially around the wheel support frame 20. Partially shown is a transparent housing cover 21, which overlies the oscillating wheel and prevents the collection of dust and lent thereon.

The plurality of tape restraining shoes 40 are attached to the support plate 20 by means of bolts, screws, or other fastening mechanisms 42 which retain the tape restraining shoes tightly in place, but which may be easily unfastened for removal and/or replacement of the restraining shoe.

Figure 2:
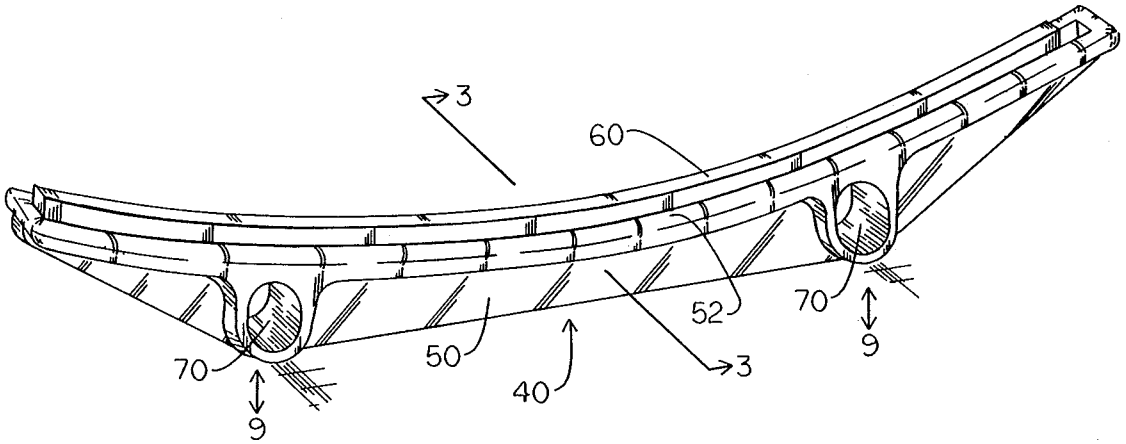
FIG. 2 is a perspective view of the improved tape restraining shoe according to a preferred embodiment.
Figure 3:
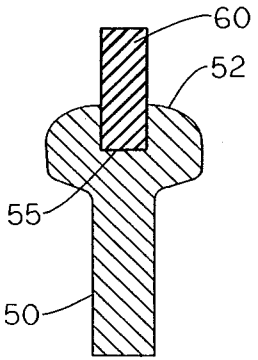
FIG. 3 is a cross sectional view taken along lines 3—3 of FIG. 2.

FIG. 2 illustrates the tape restraining shoe 40 in close detail and shows an upper yoke portion 50 and an arcuately shaped undersurface 52. The undersurface 52 includes a channel or track 55 therein which retains a wear resistant strip 60. The wear resistant strip 60 is retained in the track 55 by a "compression fit" (width of strip is slightly greater than the width of the groove) although a light adhesive coating might be included on the outer surface of the strip to further secure the strip in the track. If such a coating is used, however, it must be of a nature such that the strip is not glued securely in place but has only a tacky surface which assists in securing the compression fit. It is important that the wear strip 60 be easily removed from the track 55 for replacement.

Preferably to achieve the "compression fit," the wear strip has an upper portion that is maintained in the track and a lower portion 62, approximately one-third to one-half of the depth of the strip, extends below the arcuate undersurface 52 of the tape restraining shoe to guide the flexible retaining tape.

As this portion 62 extending below the shoe wears away, there is a resultant alteration of the distance between the tape restraining shoe and the flexible tape. When it is desired to adjust the position of the shoes to maintain the surface of the wear strip at a prescribed distance from the tape, but it is not desirable or necessary to fully replace the wear strip, a means for adjusting the position of the shoe is provided. Such adjustment means comprises the elongated slots 70 which are found in the upper body portion 50 of the tape restraining shoe and through which the fasteners 42 are placed to mount the shoe on the wheel plate 20.

FIG. 1 shows a portion A which is broken away to reveal the threaded aperture 71 in frame 20. The aperture 71 receives the fastener 42 that is used to attach the tape restraining shoe 40 to the frame 20. It is merely a substantially round aperture drilled or tapped in the face of the supporting plate 20. The elongated openings or slots 70 in the tape restraining shoe are positioned over the apertures 71 and the fasteners 42 inserted therethrough and tightened into place. Because the slots 70 are elongated and the axis of the elongation is substantially perpendicular to the undersurface 52 of the shoe, the slot 70 may be adjustably aligned with the aperture 71 to set the distance between the undersurface of the resistant strip 60 and the flexible tape 30. Any type of known device for gauging the distance between the two arcuate surfaces may be utilized to correctly position the tape restraining shoe. After the restraining shoe is positioned properly, the bolts or other fastening devices 42 are inserted through the hole 70 and into the apertures 71 and tightened into place. The head of the bolt or screw 42 extends over the edges of the body portion surrounding slot 70 and biases the shoe against the wall of the plate 20. If it becomes necessary to make further adjustments, the shoe may be adjusted radially outwardly or inwardly in the direction of the arrows b, to alter the positioning of the shoe.

While the tape restraining shoes may be formed of a variety of materials, the preferred material is a zinc aluminum alloy which is known to be efficient in conducting heat, which conductivity will direct the heat away from the flexible inserting tapes and the machine.

The wear resistant strip may be formed of a variety of materials including many polymers known to be friction resistant and wear resistant, but the preferred material is Rulon TM, a teflon product which is reinforced with mica and preferred because of its strength, durability, and heat absorbency. Rulon TM is the tradename of a proprietary product of Dixon Industries, Bristol, R.I. The polymeric material may be formed in sheets or loaves and sliced to prescribed size. The body 50 of the tape restraining shoe is molded or cast. The wear resistant strips 60 are then inserted in the track 55.

Such construction has provided an efficient means for dissipation of heat, a means for adjusting the distance between the restraining shoe and the flexible inserting tapes, and an improved means for replacing the wear strip without replacing the entire shoe. Other and further modifications and variations of the invention may be made while remaining within the scope of the claims below.

What is claimed is:

1. A tape restraining shoe of the type used in shuttleless looms to guide and maintain the flexible inserting members as they are wrapped about and extended from the oscillating wheels by which they are driven, and wherein the oscillating wheels are mounted on an underlying stationary support plate; said restraining shoe comprising:

(a) a body having an upper yoke, and a sole portion which lies immediately above the flexible inserting member to maintain the inserting member on its oscillating track;

(b) a wear strip mounted on said sole portion adjacent said flexible inserting member;

(c) means for adjustably mounting said shoe such that the surface of said wear strip is a prescribed distance from the flexible inserting member; said means including:

(i) said upper yoke having a pair of spaced slots therethrough for receiving a fastener; said slots having an elongated shape wherein the axis of the elongation is substantially perpendicular to said sole portion;

(ii) said support plate including a plurality of apertures aligned with said slots when said shoe is positioned for mounting on said support plate; said apertures being of a size smaller than said slot;

(iii) a fastener means having an enlarged head for insertion through said slot and an underlying one of said support plate apertures to secure said shoe to the support plate;

whereby said enlarged fastener head overlaps the edges of said slot to bias said shoe against the support plate when said fastener is tightened into place.

2. A tape restraining shoe according to claim 1 wherein said replaceable wear strip is formed of a friction-resistant, wear resistant polymeric material.

3. A tape restraining shoe according to claim 1 where in said replaceable wear strip is formed of Rulon TM.

4. A tape restraining shoe of the type used in shuttleless looms to guide and maintain the flexible inserting members as they are wrapped about and extended from the oscillating wheels by which they are driven, and wherein the oscillating wheels are mounted on an underlying stationary plate; said restraining shoe comprising:

(a) a body portion and a sole portion; said sole portion including means for releasably mounting a replaceable wear strip mounted therein;

(b) a replaceable wear strip mounted in said sole; said wear strip being formed of a material having the characteristics of being heat absorbent and wear resistant;

whereby, as said wear strip becomes worn, it may be removed from said sole and replaced with a new strip.

5. A tape restraining shoe according to claim 4 wherein said means for releasably mounting said wear strip comprises:

(a) a channel extending longitudinally through the midportion of said sole for receiving a first portion of said wear strip; a second portion of said strip lying outside said channel at a point immediately above the flexible inserting member to absorb heat and friction therefrom;

(b) said wear strip comprising a long, relatively narrow strip of material of a width dimension slightly greater than the corresponding dimension of said track such that said strip is retained in said track by a compression fit.

6. A tape restraining shoe of the type used in shuttleless looms to guide and maintain the flexible inserting members as they are wrapped about and extend from the oscillating wheels by which they are driven, and wherein the oscillating wheels are mounted on a stationary support plate; said restraining shoe comprising:

(a) a body portion and a sole portion having a replaceable wear strip mounted therein; said body portion having means for adjustably mounting said shoe to the supporting plate of the oscillating wheel such that said wear strip is adjustably positioned a prescribed distance from the flexible inserting member; and (b) said sole portion including means for removably mounting said wear strip in said shoe;

whereby said restraining shoe may be adjusted as necessary to maintain replaceable wear strip a prescribed distance from the inserting tape and the wear resistant strip may be removed and replaced as required.

7. A tape restraining shoe according to claim 6 wherein said replaceable wear strip is formed of a friction-resistant, wear resistant polymer material.

8. A tape restraining shoe according to claim 6 wherein said replaceable wear strip is formed of Rulon TM.

9. A tape restraining shoe according to claim 6 wherein said means for adjustably mounting said shoe to the supporting housing includes:

(a) said body portion having an upper yoke member along the side of said body portion which is opposite said sole portion;

(b) said yoke having a pair of spaced slots therethrough for receiving a fastener; said slots having an elongated shape wherein the axis of the elongation is substantially perpendicular to said sole portion;

(c) said support plate including a plurality of apertures corresponding to said slots through which fastener means extend for mounting said shoe;

(d) said fastener means having an enlarged head for insertion through said slot and an underlying one of said support plate apertures to secure said shoe to the support plate;

whereby said enlarged fastener head overlaps the edges of said slot to bias said shoe against the support plate when said fastener is tightened into place.

* * * * *